United States Patent [19]

Savio et al.

[11] 4,155,547

[45] May 22, 1979

[54] TORSION SPRING TYPE WRIST EXERCISING DEVICE

[76] Inventors: Dino M. Savio, 785 Bay Esplanade, Clearwater, Fla. 33515; John P. Barrett, Jr., 1904 Oakdale La. South, Largo, Fla. 33540

[21] Appl. No.: 837,047

[22] Filed: Sep. 27, 1977

[51] Int. Cl.[2] ..... A63B 21/22

[52] U.S. Cl. ..... 272/67; 272/140; 272/DIG. 4; 272/DIG. 5; 73/379

[58] Field of Search ..... 272/140, 143, 67, 68, 272/142, 143, 137; 73/136 A, 379, 380, 133 R, 136 R, 1 C; 128/25 R, 26

[56] References Cited

U.S. PATENT DOCUMENTS

| | | | |
|---|---|---|---|
| 2,909,055 | 10/1959 | Fish | 73/1 C |
| 3,084,547 | 4/1963 | Nielsen | 272/68 X |
| 3,330,558 | 7/1967 | Simons | 272/68 |
| 3,708,164 | 1/1973 | Griffin | 272/140 X |
| 4,026,548 | 5/1977 | Birdwell | 272/142 X |

FOREIGN PATENT DOCUMENTS 1131654 10/1968 United Kingdom.

*Primary Examiner*—Richard C. Pinkham
*Assistant Examiner*—William R. Browne
*Attorney, Agent, or Firm*—Clarence A. O'Brien; Harvey B. Jacobson

[57] ABSTRACT

An arm exercising device for strengthening of the wrist, forearm and elbow, the invention comprises a pair of longitudinally aligned tubular members movable axially relative to each other, such movement being resisted by an adjustable spring force. A spring system has its length varied to adjust the tension, and thus the torsion of said spring system, one of the tubular members preferably being formed of a clear material in order that the adjustment can be visually observed.

9 Claims, 4 Drawing Figures

TORSION SPRING TYPE WRIST EXERCISING DEVICE

BACKGROUND AND SUMMARY OF THE INVENTION

Wrist and forearm exercising devices have previously been disclosed in the art, certain of said devices having hand grips which are twisted in relation to each other about a longitudinal axis. In such devices, resistance to torsional forces imparted to the devices by a user is typically accomplished by friction brake members, cam devices, and springs. Devices utilizing a flat spring member as the resistive portion and which are further capable of varying torsional resistance have also been available according to the teachings of the prior art, torsion being varied in such devices by the replacement of one flat steel spring member with a second spring member having a different elasticity. U.S. patents which disclose such spring devices include:

U.S. Pat. No. 2,668,055—Feb. 2, 1954
U.S. Pat. No. 2,818,253—Dec. 31, 1957
U.S. Pat. No. 3,084,547—Apr. 9, 1963
U.S. Pat. No. 3,211,453—Oct. 12, 1965
U.S. Pat. No. 3,330,558—July 11, 1967
U.S. Pat. No. 3,708,164—Jan. 2, 1973.

These prior devices do not disclose an exerciser unit wherein the torsional resistance of said unit can be varied by longitudinally adjusting the point of connection between at least one of the hand grip members comprising the device and a flat spring utilized within the device to resist axial displacement of portions of the device relative to each other.

The present invention provides an exerciser device for strengthening the wrist, forearm and elbow, the present device including an adjustment mechanism which is useful in other exercising devices wherein the torsional resistance of the device is intended to be adjustable. In particular, the present invention provides means for adjusting the torsional resistance of two axially movable portions of an exercising device, the adjustment means particularly comprising mechanisms for varying the effective length, and thus the tension, of one or more spring members effectively joined to the axially movable portions of said device. Major portions of the present adjustment mechanisms are disposed interiorly of the device itself, at least one of the axially movable portions being preferably formed of a clear material in order that the adjustment of the spring tension can be visually observed. In a preferred embodiment of the invention, a pair of tubular members aligned along the longitudinal axis thereof and movable axially relative to each other form a housing enclosing a rod threaded along at least a portion thereof, the threaded portion of the rod being attached to a knob disk member disposed at one end of the device, the rod being mounted for rotation within the housing formed by the tubular members. A pair of flat spring members stationarily mounted at the end of the device opposite the knob member extends longitudinally along the rod in spaced relation thereto and preferably on opposite sides thereof. The flat spring members are each received within slot-like apertures formed in an adjustment disk, the adjustment disk having a central aperture formed therein for receiving the threaded portion of the rod therethrough, the adjustment disk being movable longitudinally of the rod on rotation of said rod by means of axial displacement of the knob member by a user of the device. Since the flat spring members are stationarily attached at one end of the device and effectively attached at the other end of the device at a variable location thereof by the adjustment disk, the torsional resistance evidenced by the exerciser device is thus varied according to the needs of a user.

Accordingly, it is an object of the present invention to provide an exerciser device for strengthening of the wrist, forearm and elbow which is capable of varying resistance to attempts by a user to operate said device, variance of the resistance of the device being effected by a simple external adjustment not requiring replacement of any portion of the device.

It is a further object of the invention to provide an adjustment mechanism for an exerciser device for varying the torsional resistance of the device without the necessity for access into the internal portions of said device.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
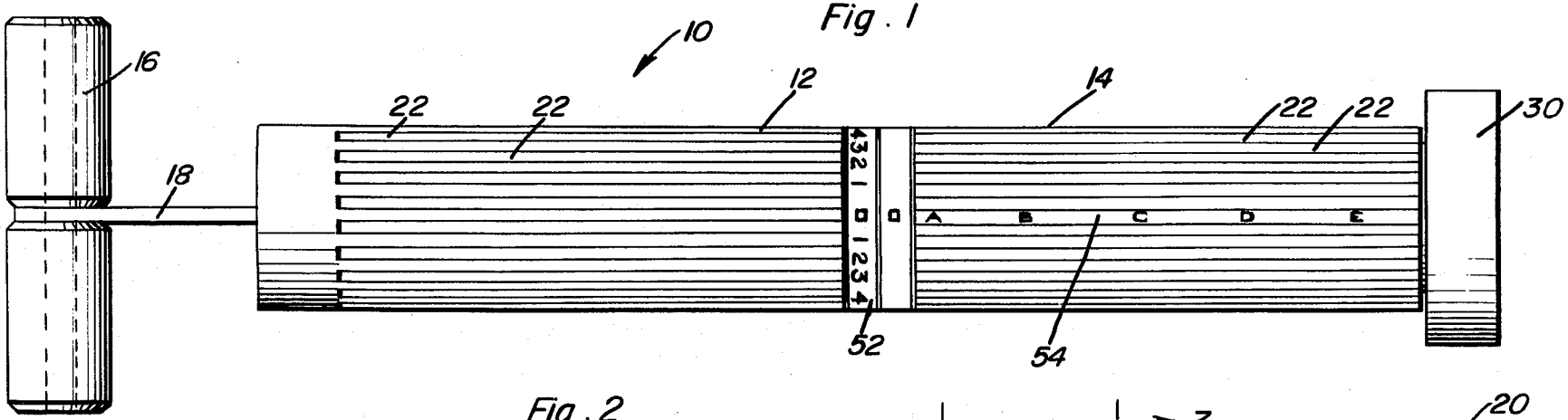
FIG. 1 is an elevational view of the present exerciser device.
Figure 2:
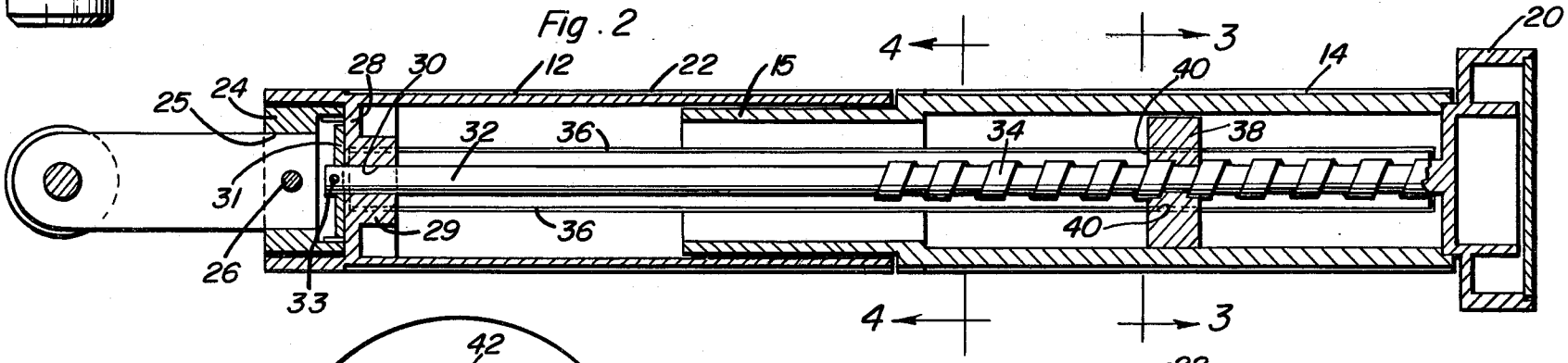
FIG. 2 is an elevational view in section of the present device.

Referring to the drawings and in particular to FIGS. 1 and 2, the present exerciser device is seen generally at 10 to comprise tubular members 12 and 14 of essentially identical diameter and aligned along the longitudinal axes thereof, the tubular members 12 and 14 contiguously abutting at the inner ends thereof and being axially movable relative to each other. The tubular member 14 is seen to have a reduced neck portion 15 formed at the inner end thereof, the reduced neck portion 15 extending into the interior of the inner end of the tubular member 12 to provide a rotatable, loose fitting connection between said members 12 and 14. The tubular member 12 is seen to have a handle 16 connected to the outer end of said member 12 by means of a yoke plate 18. The tubular member 14 further has a knob member 20 of substantially cylindrical conformation disposed at the outer end thereof, the knob member 20 being axially movable relative to the tubular member 14. The tubular members 12 and 14 are both seen to have a plurality of longitudinally extending knurls 22 disposed on the exterior surfaces thereof about their full peripheries. The knurls 22 enable a user of the device to more effectively grip the tubular members 12 and 14 without slippage of the hands of the user relative to the tubular members. The material from which the tubular member 14 is formed is preferably chosen to be a substantially clear plastic or similar material which allows a user to visually observe adjustment mechanisms disposed interiorly of the tubular member 14 as will be described hereinafter.

A scale 52 disposed on the exterior surface of the inner end of the tubular member 12 enables a user of the device to measure the relative rotation between the tubular members which he is able to effect by virtue of operation of the device 10. A scale 54 disposed on the exterior surface of the tubular member 14 and longitudinally thereof enables a user of the device to adjust the tension thereof in a reproducable fashion and further provides a reference for use with the scale 52.

Figure 3:
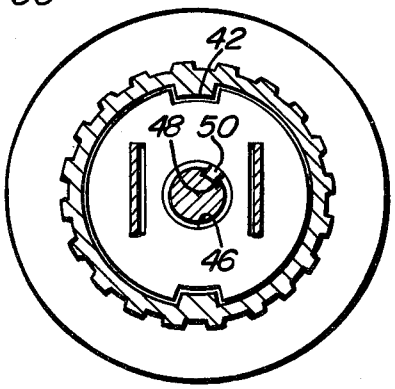
FIG. 3 is a sectional view taken along line 3—3 of FIG. 2.

Referring particularly to FIG. 2, the outer end of the tubular member 12 is seen to be provided with a plug member 24, a slot 25 in the plug member 24 receiving the inner end of the yoke plate 18 thereinto, the yoke plate 18 being secured within the slot 25 by means of a pin 26. The plug member 24 is stationarily mounted in the outer end of the tubular member 12 such as by ultrasonic welding. Inwardly of and substantially abutting inwardly disposed perimetric portions of the plug member 24, an annular mounting flange 28 (which may be integrally formed with the tubular member 12) is disposed within said member 12, the flange 28 having a neck portion 29. An aperture 30 extends centrally through the neck portion 29 and flange 28, the aperture 30 receiving one end of a central rod 32 thereinto. Although the rod 32 is rotatable within the aperture 30, the outer end of said rod 32 extends outwardly of the aperture 30 and is held by a washer 31 and cotter pin 33, the cotter pin 33 extending through an axially disposed aperture in the outer end of the rod 32 in a known manner. The other end of the central rod 32 is stationarily mounted to an inner plate portion of the knob member 20 at the outer end of the tubular member 14. At least that portion of the central rod 32 which lies within the tubular member 14 is formed with threads 34 helically arranged along the length thereof. Rotation of the knob member 20 causes the central rod 32 to also be rotated, an adjustment disk 38 movable along the threaded portion of the rod 32 being displaceable longitudinally of the tube 14 on rotation of said knob member 20. The adjustment disk 38 is seen also in FIG. 3 to be formed with a central aperture 46, parallel slots 40 being spaced axially from the aperture 46 and oppositely spaced recesses 44 being formed in perimetric portions of the disk 38. Flat spring members 36 are received within the slots 40, the spring members 36 being received within the slots 40 and being movable relative to the adjustment disk 38 in a manner similar to the receipt of the central rod 32 within the aperture 46.

Figure 4:
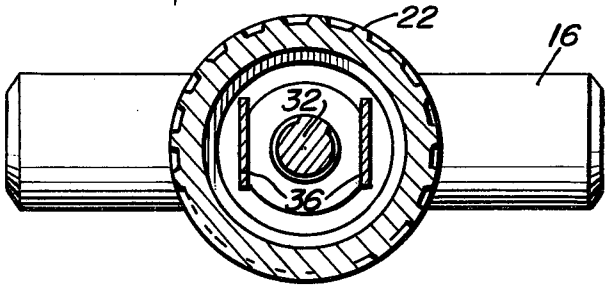
FIG. 4 is a sectional view taken along line 4—4 of FIG. 2.

The flat spring members 36 extend virtually the full length of the device 10, the ends of the spring members 36 disposed at the outer end of the tubular member 12 being stationarily mounted within the neck portion 29 of the annular flange 28. The opposite ends of the flat spring members 36 preferably are not connected to any element of structure and are thus disposed freely within the tubular member 14. The major body portions of the flat spring members 36, as can also be seen in FIG. 4, extend throughout the interior of the device 10 in substantially parallel relation to each other and in spaced relation to opposing surfaces of the central rod 32.

Oppositely disposed interior surface portions of the tubular member 14 extend toward the longitudinal axis of said tubular member 14 to form raised tracks 42, the tracks 42 being received within the recesses 44 of the adjustment disk 38. The tracks 42 and recesses 44 act to maintain the adjustment disk 38 in a predetermined orientation on longitudinal displacement of said disk 38 when the knob 20 and control rod 32 are rotated, the flat spring members 36 being thereby prevented from bending axially.

Recesses 48 disposed between the threads 34 of the rod 32 follow a raised track 50 formed integrally with the disk 38 and extending into the aperture 46, the track 50 following the recesses 48 to provide additional stability to the disk 38 as said disk 38 moves longitudinally of the device 10.

The location of the adjustment disk 38 within the tubular member 14 varies the tension of the flat spring members 36 by varying the effective lengths of said spring members. Accordingly, a user of the device 10 can set the position of the disk member 38 to any of the settings A through E as indicated on the scale 54, the disk 38 being visible through the tubular member 14, by rotation of the knob member 20. Such rotation of the knob member 20 rotates the rod 32 as aforesaid to move the disk 38 longitudinally of said device 10. In use, the tubular members 12 and 14 can be grasped one each with the hands and rotated relative to each other to provide a straight wrist extension and flexion exercise. Further, the handle 16 can be grasped with one hand while the other hand grasps the tubular member 14, exercises involving radial wrist extension, ulnar wrist flexion, and supination/pronation being possible. The exercises performable through use of the present device can be varied in degree of difficulty by means of the location of the adjustment disk 38 within the tubular member 14, the tension of the spring members 36 being thereby varied as aforesaid.

It is to be noted that the force adjustment mechanism of the present invention can take forms other than that as shown expressly hereinabove. For example, the tubular member 14 can be configured to telescope within the tubular member 12, the tubular member 14 then having a fixed plug member disposed therewithin and having a slot or slots formed in the plug member to receive a spring or springs therewithin in a fashion similar to the disposition of the flat spring members 36 within the slots 40 of the adjustment disk 38. Movement of the tubular member 14 within said tubular member 12 would then act to vary the effective length, and thus the tension, of the springs. It is to be further seen that other structural elements of the present device could be formed other than as explicitly shown in the drawings, the handle 16, for example, being readily replaceable by other structure adapted to be grasped by a hand, such as a disk provided on the outer end of the tubular member 12. Still further, it is to be noted that the flat spring members 36 can take the form of elongated coil spring elements or similar elastic structures, the tension of which can be varied in the manner provided by the adjustment mechanism of the invention.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An exerciser device to which force is applied by a user thereof, the device being variably resistant to the applied force, comprising:

a housing having at least two portions with each portion being adapted to be gripped by a separate hand of a user and the portions being movable relative to each other, the portions being rotatably connected and adapted to be at least rotatably displaced relative to each other by a user of the device;

spring means for applying a resistive force against the rotational displacement of the two portions of the housing and being fixed to one portion of said housing at one portion of said spring means;

manual adjustment means for selective longitudinal adjustment along the longitudinal axis of the housing for holding the spring means at selectively movable positions relative to said housing for varying the effective length, and thus the torsion of said spring means during a twisting operation; and a handle member mounted on one portion of said housing with the longitudinal dimension of the handle disposed transversely to the longitudinal dimension of said housing.

2. The exerciser device of claim 1, wherein at least a portion of the housing is formed of an optically transparent material, at least a portion of the adjustment means being disposed within said portion and being visible therethrough.

3. An exerciser device to which force is applied by a user thereof, the device being variably resistant to the applied force, comprising:

a housing having at least two portions movable relative to each other, the portions being adapted to be displaced relative to each other by a user of the device;

spring means for applying a resistive force to the housing and being fixed to one portion of said housing at one portion of said spring means;

adjustment means movable relative to at least one portion of the housing and holding the spring means movably relative to said adjustment means for varying the effective length of said spring means, said adjustment means comprising:

an elongated rod disposed within the housing and mounted for rotational movement therewithin, at least a portion of the rod having threads formed thereon;

a body member having an aperture formed therein for receiving the threaded portion of the rod thereinto, the body member having at least one aperture for receiving the spring means slidably thereinto; and, follower means formed on the body member for following the threaded portion of the elongated rod, the body member being thereby displaced along the rod on rotation of said rod to vary the effective length, and thus the tension, of said spring means.

4. The exerciser device of claim 3 and further comprising a knob member disposed at one end of the housing and movably mounted relative thereto, the rod being fixedly mounted to one end of the rod, the rod being thereby rotatable from externally of said housing.

5. The exerciser device of claim 3 and further comprising track means formed on the inner walls of at least a portion of the housing for maintaining the body member in a predetermined orientation relative to the housing, and follower means formed on the body member and mating with said track means for causing the body member to follow said track means.

6. The exerciser unit of claim 3, wherein the spring means comprise at least one flat spring member disposed within the housing and being fixedly mounted at one end thereof to said housing, the spring member extending longitudinally of the housing and in spaced relation to the rod, the free end of the spring member being slidably received through the aperture in the body member.

7. The exerciser unit of claim 6, wherein the aperture formed in the body member is rectangular in conformation and of dimensions slightly greater than the cross-sectional dimensions of the spring member.

8. The exerciser unit of claim 3, wherein the two portions of the housing are tubular and are aligned along the longitudinal axes thereof, the exterior surface of the portions having knurl members formed longitudinally of the housing and spaced relative to each other to provide a friction grip surface.

9. The exerciser unit of claim 3 and further comprising scale means disposed on the housing for indicating the degree of adjustment of the adjustment means.

* * * * *